United States Patent [19]

Ross

[11] Patent Number: 4,676,743

[45] Date of Patent: Jun. 30, 1987

[54] VERTICAL AIR FLOW INGOT PUSHER FURNACE

[75] Inventor: Robert H. Ross, Meadville, Pa.

[73] Assignee: Seco/Warwick Corporation, Meadville, Pa.

[21] Appl. No.: 858,115

[22] Filed: May 1, 1986

[51] Int. Cl.[4] ..... F27B 9/04

[52] U.S. Cl. ..... 432/152; 432/144; 432/176

[58] Field of Search ..... 432/152, 59.8, 189, 432/148, 176, 144

[56] References Cited

U.S. PATENT DOCUMENTS

| | | | |
|---|---|---|---|
| 2,039,429 | 5/1936 | Lydon | 432/176 |
| 3,537,405 | 11/1970 | Verhoeven | 432/152 |
| 4,012,190 | 3/1977 | Dicks et al. | 432/144 |
| 4,162,141 | 7/1979 | West | 432/152 |
| 4,395,233 | 7/1983 | Smith et al. | 432/176 |
| 4,514,167 | 4/1985 | Royer | 432/152 |
| 4,516,012 | 5/1985 | Smith et al. | 432/176 |
| 4,518,352 | 5/1985 | Gillhaus et al. | 432/152 |
| 4,591,338 | 5/1986 | Sahai et al. | 432/152 |

*Primary Examiner*—Henry C. Yuen
*Attorney, Agent, or Firm*—Davis Chin

[57] ABSTRACT

An ingot pusher furnace of the vertical air flow type includes distributing means for preventing short circuiting of a gaseous medium around the ends of ingots to be heated so as to produce a more uniform heat transfer along the entire length of the ingots. The distributing means comprises a pair of air distribution baffles which force the gaseous medium contained in an enclosure to flow towards the center portions of the ingots so as to facilitate uniform heating throughout the ingots. In an alternate embodiment, the distributing means comprises a pair of movable side baffles which is movable to be angled position so that its lower ends are adjacent the ends of the ingots.

4 Claims, 4 Drawing Figures

VERTICAL AIR FLOW INGOT PUSHER FURNACE

BACKGROUND OF THE INVENTION

This invention relates generally to ingot pusher furnaces and more particularly, it relates to an improved ingot pusher furnace of the vertical air flow type which includes means for preventing the short circuiting of heated gases around the ends of an ingot to be heated so as to produce a more uniform heat transfer along the length of the ingot.

It is generally known in the art that ingot pusher furnaces have been designed to accommodate very large aluminum ingots to be heated. Currently, these aluminum ingots are in the range of ten to thirty feet in length, three to six feet wide and ten to thirty inches thick. Some of these prior art furnaces have fixed side baffles disposed adjacent the ends of the ingot whose length is at the maximum acceptable by the furnace. However, such furnaces are also often used to heat ingots with a shorter length. During the heating of the shorter length ingots in these furnaces, a substantial amount of the heating medium is short circuited between the fixed side baffles and the ends of the ingot to be heated. This is due to the fact that the path of least resistance for the gas flow is around the ends of the ingot. As a result, the end portions of the ingot are often overheated and generally have a much higher temperature than the center portions thereof, thereby causing non-uniform heating of the aluminum ingots.

It would therefore be desirable to provide an improved ingot pusher furnace of the vertical air flow type which includes means for preventing the short circuiting of heated gases around the ends of the ingot to be heated. This is accomplished in the present invention by the provision of either air distribution baffles or movable side baffles.

SUMMARY OF THE INVENTION

Accordingly, it is a general object of the present invention to provide an improved ingot pusher furnace of the vertical air flow type which is relatively simple and economical to manufacture and assemble, but yet overcomes the disadvantages of the prior art furnaces.

It is an object of the present invention to provide an ingot pusher furnace of the vertical air flow type which includes means for preventing the short circuiting of heated gases around the ends of an ingot to be heated.

It is another object of the present invention to provide an ingot pusher furnace of the vertical air flow type which includes a pair of air distribution baffles to force the heated gases to flow toward the center portion of the ingot so to provide uniform heating throughout the ingot.

It is still object of the present invention to provide an ingot pusher furnace of the vertical air flow type which includes a pair of movable side baffles to force the heated gases to flow toward the center portion of the ingot so as to facilitate uniform heat transfer.

In accordance with these aims and objectives, the present invention is concerned with the provision of an improved ingot pusher furnace of the vertical air flow type which includes an insulated furnace enclosure formed by a bottom wall, a pair of side walls, a front wall, a rear wall and a top wall. The enclosure receives a plurality of ingots to be heated. A plurality of heated sources are provided to heat a gaseous medium within the enclosure. A plurality of fans are provided to circulate the gaseous medium within the enclosure. A pair of vertical side baffles are disposed in a parallel, spaced apart relationship to the side walls of the enclosure. Each of the vertical side baffles extend from the rear wall of the enclosure to the front wall. Each of the vertical baffles has an upper end and a lower end. A horizontal baffle having downwardly sloping members extends from the rear wall to the front wall. The downwardly sloping members are joined fixedly to the respective upper ends of the vertical side baffles. A pair of air distribution baffles are connected to the lower ends of the vertical side baffles and extend from the lower ends thereof to the end portions of an ingot whose length is at the minimum acceptable by the furnace. The air distribution baffles extend from the rear wall to the front wall and has a plurality of slots formed therein. Each of the slots has a width equal to the spacing between adjacent ingots. The air distribution baffles serve to force the gaseous medium contained in the enclosure to flow towards the center portion of the ingot so as to provide uniform heating throughout the ingot.

In another embodiment of the present invention, movable side baffles are provided whose lower ends are positionable in closely spaced proximity with the ends of the shortest length ingots so as to force the gaseous medium contained in the enclosure to flow towards the center portion of the ingots.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
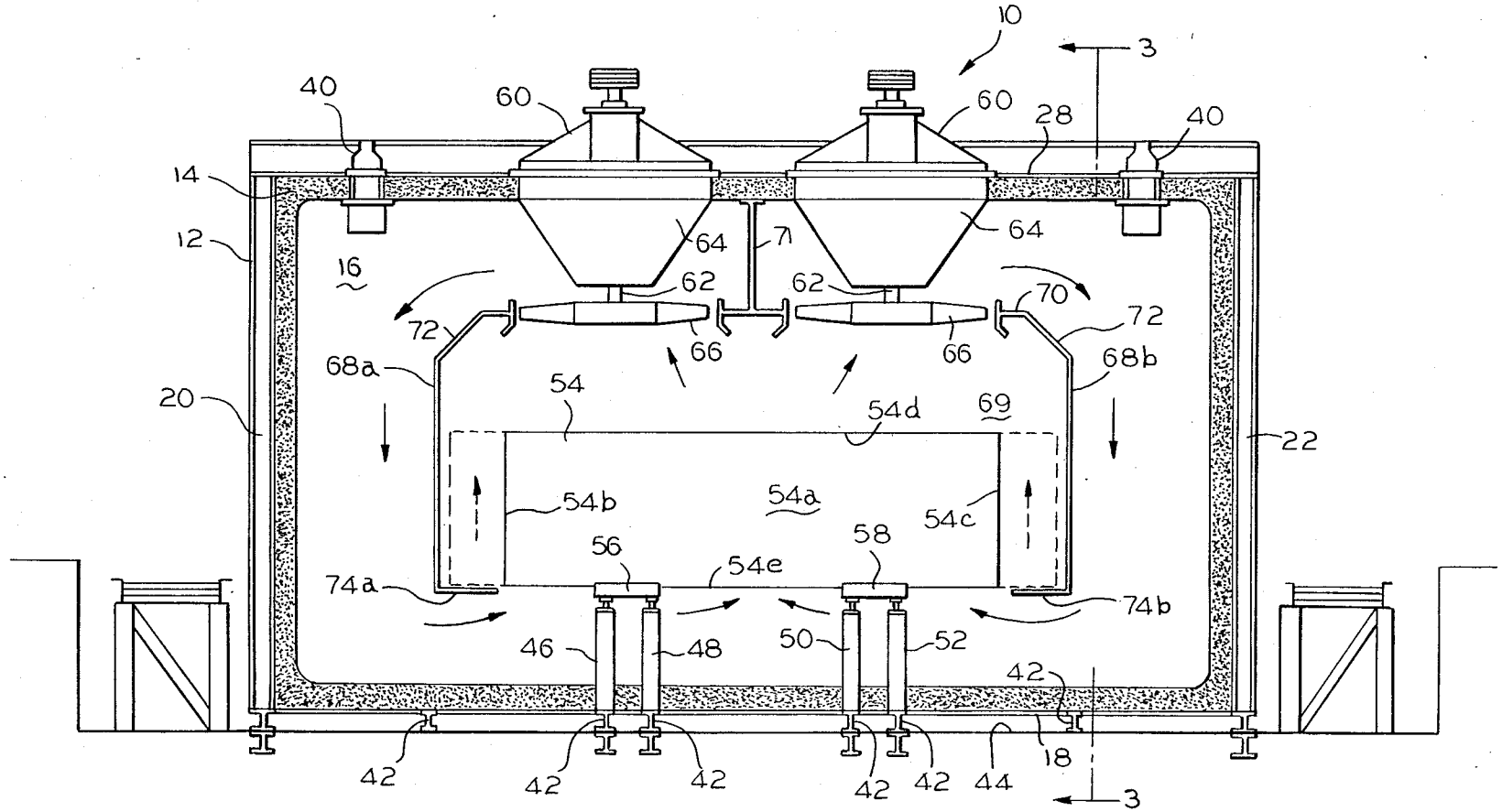
FIG. 1 is a front elevational view of an ingot pusher furnace of the vertical air flow type of the present invention.
Figure 2:
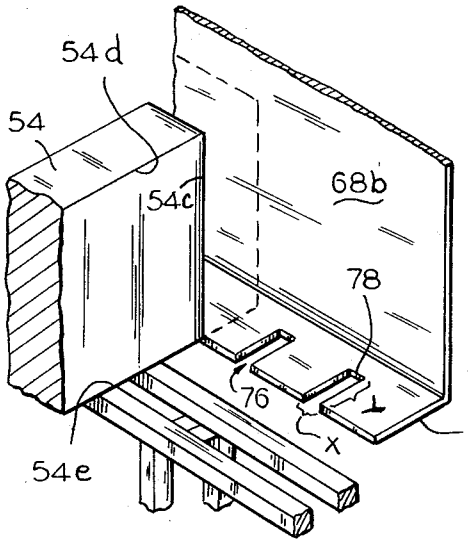
FIG. 2 is an enlarged view of a portion of FIG. 1, illustrating details of the air distribution baffle.
Figure 3:
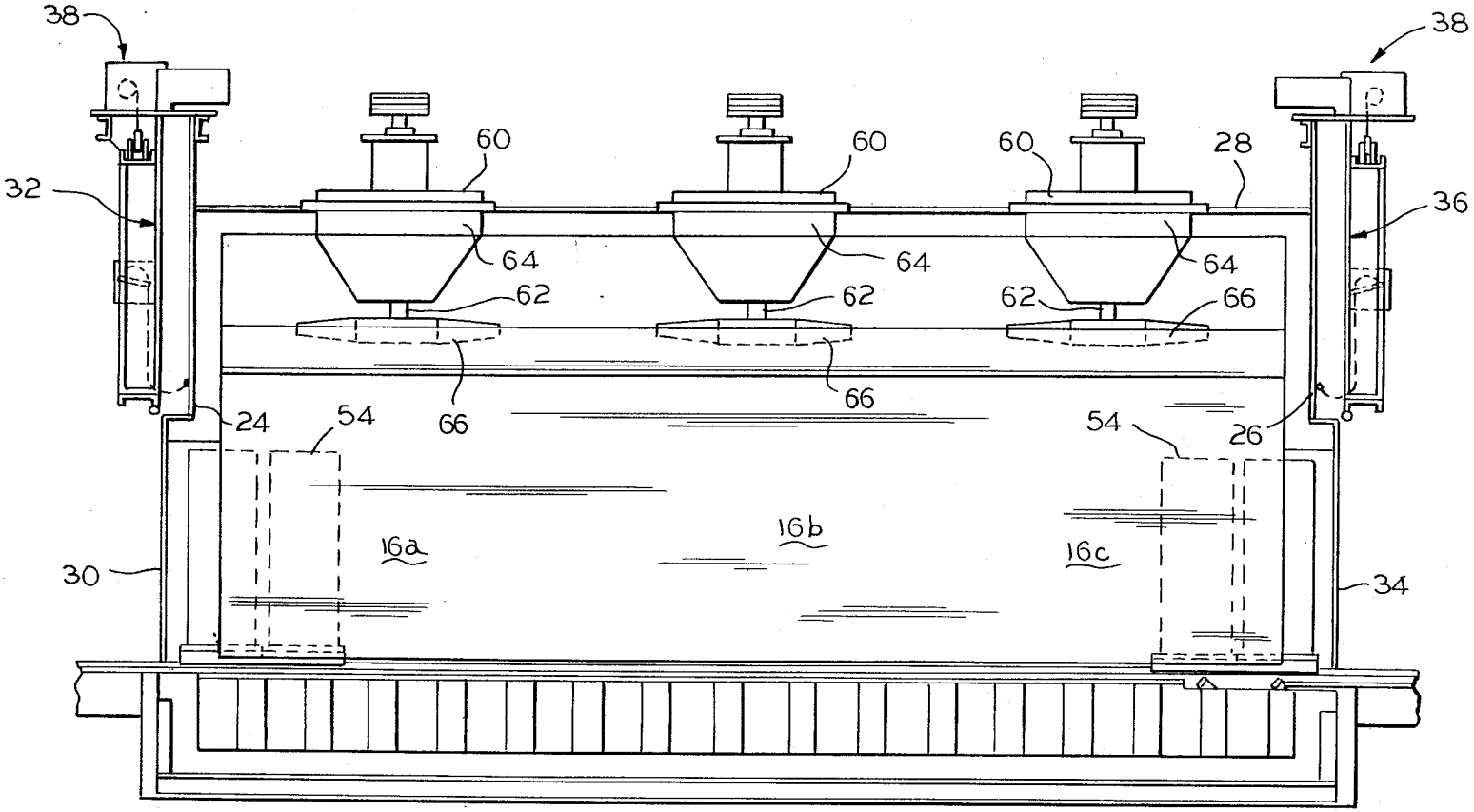
FIG. 3 is a side elevational view of the furnace, taken along the lines 3—3 of FIG. 1.

Referring in detail to the various views of the drawings, there is illustrated in FIGS. 1 through 3 an improved ingot pusher furnace of the vertical air flow type in accordance with the present invention designated generally by reference numeral 10. The improved ingot pusher furnace is formed of a sheet metal outer shell 12 with a layer 14 of insulating refractory material on its interior to define an insulated enclosure 16. The pusher furnace 10 includes a bottom wall 18, a pair of side walls 20 and 22, a front wall 24, a rear wall 26 and a top wall or roof 28. The front wall 24 is formed with a large entrance opening 30 which is covered by a front door 32. The rear wall 26 is formed with a large exit opening 34 which is covered by a rear door 36. The front and rear doors are adapted to slide in a vertical plane under the control of elevating mechanisms 38 which are well known in the art.

A plurality of conventional gas burners 40 are positioned in the top wall 28 and deliver a hot gaseous medium to the insulated enclosure 16. In alternate embodiments of the pusher furnace, radiant tube gas fired heaters or electric heaters may be utilized to heat the enclosure 16. The insulated enclosure 16 is divided into a plurality of heating zones 16*a*, 16*b* and 16*c*. As can be seen from FIG. 1, the bottom wall 18 is supported on a plurality of I-beams 42 which are disposed above the surface 44. A plurality of rail support posts 46, 48, 50 and 52 are formed in the bottom wall 18 which facilitate the support and movement of a plurality of aluminum ingots 54 to be heated within the enclosures 16. The ingots 54 are substantially rectangular in shape and has a center portion 54*a*, a first end portion 54*b*, a second end portion 54*c*, a top portion 54*d*, and a bottom portion 54*e*. The rail support posts 46 and 48 support a shoe assembly 56 via support rails, and the rail support posts 50 and 52 support a shoe assembly 58 via support rails. The shoe assembly 56 and 58 are used to support the underneath surface of the sluminum ingots 54.

The top wall 28 supports a plurality of large gas recirculating fan assemblies 60. Each of the recirculating fan assemblies 60 includes a vertical extending support shaft 62 which is journalled in a mounting frame 64 disposed in the roof 28. A large axial flow or centrifugal fan member 66 is positioned on the lower end of the shaft 62. In order to rotate the shaft, a motor (not shown) may be provided. It should be understood that the shaft 62 may be rotated by the motor in either direction for an axial fan so as to cause the fan member 66 when rotated to move a hot gaseous medium either upwardly in the direction of the arrows as shown in FIG. 1 or downwardly in a direction opposite to the arrows. Although in the embodiment disclosed there are two rows of fans extending through each of the heating zones for the entire length of the furnace, it should be apparent to those skilled in the art that only a single fan in each heating zone could be employed alternatively.

Within the furnace enclosure 16, there are provided a pair of fixed vertical side baffles 68*a* and 68*b* which are arranged to extend vertical and in a parallel, spaced apart relationship from the side walls 20 and 22 respectively. Further, the vertical side baffles 68*a* and 68*b* extend from the rear wall 26 to the front wall 24. A horizontal baffle 70 is arranged in a generally horizontal position at the level of the fan member 66 and is connected to the upper ends of the fixed side baffles 68*a*, 68*b* by outwardly and downwardly sloping connecting members 72. The horizontal baffle 70 with it outwardly sloping connecting members 72 extend from the rear wall 26 to the front 24 of the enclosure. The horizontal baffles 70 are formed with openings to receive the fan members 66 therein. A vertical air flow divider 71 has its one end connected to the horizontal baffle and its other end connected to the roof 28 for air flow control. In addition, a pair of air distribution baffles 74*a* and 74*b* are arranged in a generally horizontal position at the level of the bottom portion 54*e* of the ingot and are connected to the respective lower ends of the fixed side baffles 68*a*, 68*b*. A working chamber 69 is defined by the horizontal baffles 70 with its outwardly sloping members 72, side baffles 68*a* and 68*b* and the air distribution baffles 74*a* and 74*b*.

Referring to FIGS. 1 and 2, it can be seen that an ingot of a maximum length which is acceptable for heating in the furnace is depicted in a dotted line. An ingot of a minimum length which is acceptable to be heated in the furnace is depicted in a solid line. It is important to note that the furnace can accommodate ingots of a varying size which ranges between the maximum length and the minimum length. The side baffles 68*a* and 68*b* are designed to be in closely spaced proximity adjacent outer faces of the maximum length ingot. Each of the air distribution baffles 74*a*, 74*b* extends from the outer faces of the shortest length ingot to be heated to the interior surfaces of the respective vertical side baffles 68*a* and 68*b*. A plurality of U-shaped slots 76 are formed in the air distribution baffles 74*a* and 74*b* so as to permit air flow between the adjacent ingots which are to be heated. Thus, the width X of the slots 76 is determined by the spacing desired between the adjacent ingots 54. The length Y of the slots 76 is selected so that the U-shaped end portion 78 of the slot is adjacent the longest length ingot to be heated, thereby permitting air flow distribution throughout the length of the longest ingot which is to be accepted by the furnace.

In normal operating conditions for heating the shortest length ingot 54 (solid line), the fan member 66 is rotated by the motor in such a direction so that the heated gases travel upwardly through the working chamber 69 discharging them toward the roof 28 of the furnace. The gases thus discharged are divided and move outwardly toward the respective side walls 20 and 22. Then, the gases are caused to circulate downwardly between the respective fixed side baffles and the side walls. At the bottom of the furnace enclosure 16, the gases are restricted and are thus caused to move inwardly toward the center portion 54*a* of the ingots. Part of the gases pass through the slots 76 in the air distribution baffles 74*a*, 74*b* and then comes up through the space between the adjacent ingots and back to the circulating fan 60. The path of the circulating gases is shown in the solid arrows in FIG. 1 of the drawings. In this manner, the ingots are heated uniformly across its entire length between the first end portion 54*b* and the second end portion 54*c*, thereby effecting a substantially uniform heating rate and temperature uniformity throughout its interior. If it were not for the air distribution baffles, most of the heated gases would be "short-circuited" around the ends of the ingots since this path is of the least resistance. This short-circuited path is indicated by the dotted arrows in FIG. 1. Accordingly, the majority of the circulating gases would be passed upwardly between the fixed side baffles and the ends of the ingot, thereby tending to overheat the outer faces of the ingot in comparison to the center portions thereof.

While the air distribution baffles shown in FIGS. 2 and 3 perform very well as a means for preventing the short circuiting of heated gases around the ends of the shorter length ingots to be heated, it suffers from the disadvantage in that it is suitable only for one particular spacing of ingots. In other words, if the space between adjacent ingots is desired to be changed, the slots in the air distribution baffles would be located incorrectly and thus would be required to be modified. A second embodiment of an ingot pusher furnace 110 of the vertical air flow type of the present invention is shown in FIG. 4 which overcomes this disadvantage.

Figure 4:
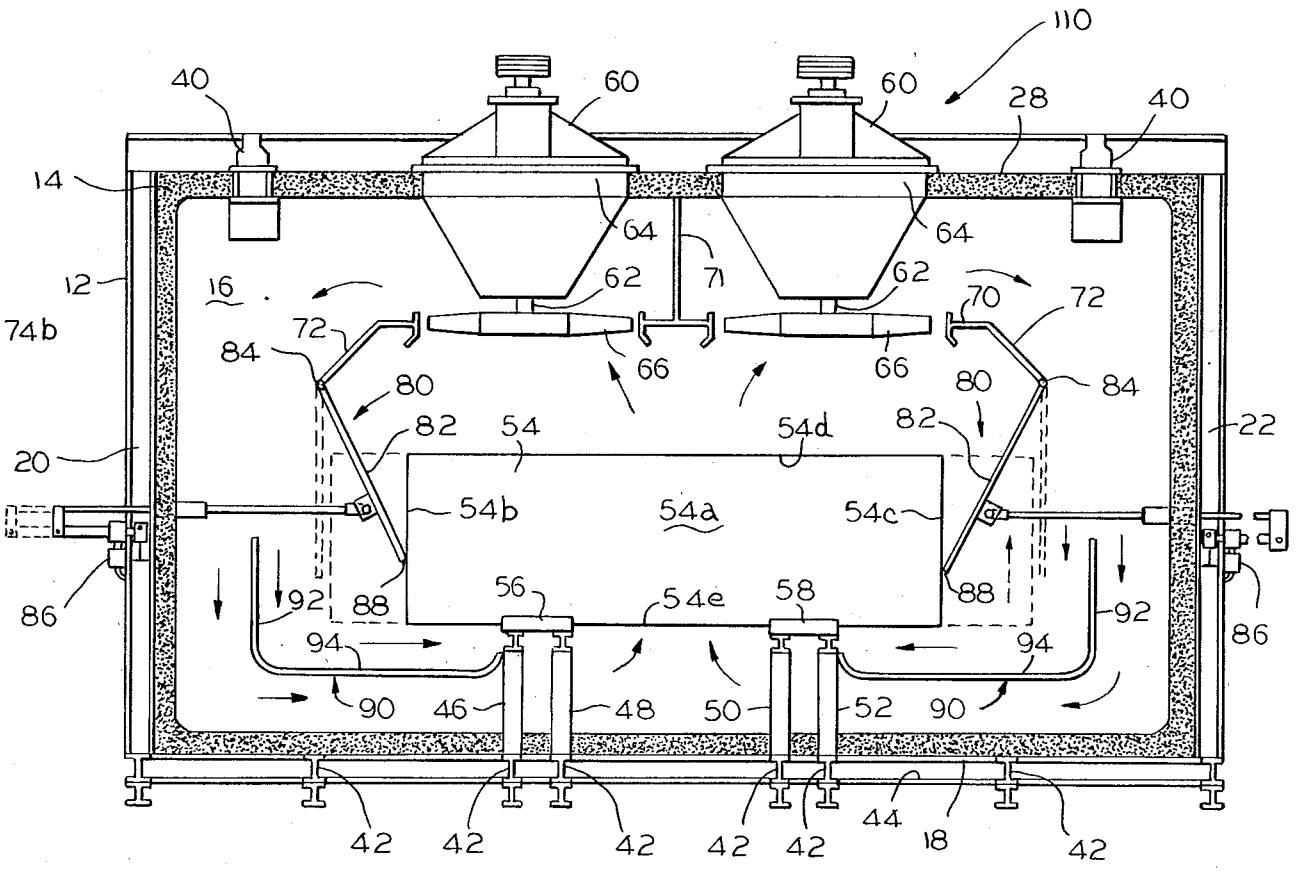
FIG. 4 is a front end elevational view of a second embodiment of an ingot pusher furnace of the present invention.

All of the components in FIG. 4 which are identical to those of FIG. 2 have been designated by the same reference numerals. The differences between the furnace 110 of FIG. 4 and the furnace 10 of FIG. 2 reside in the means for preventing the short circuiting of the heated gases past the ends of the shorter length ingots so as to facilitate uniform heating of the ingot. In particular, the air distribution baffles of FIG. 2 have been replaced by baffle means 80.

The baffle means 80 includes movable side baffles 82 which have their upper ends 84 pivotally attached to the respective outwardly sloping members 72 of the horizontal baffle 70. Actuating means formed of electromechanical linear actuators 86 are adapted for moving the side baffles 82 between a vertical position (shown in a dotted line) and an angled position (shown in a solid line). In the vertical position, the movable side baffles 82 are in a closely spaced proximity with the outer faces of the maximum length ingot which is acceptable by the furnace. This is identical to the location of the fixed side baffle of FIG. 1. In the angled position, the lower ends 88 of the movable side baffles 82 are arranged to be in closely spaced proximity with the outer faces on the end portions 54*b* and 54*c* of the shorter length ingot. When the movable side baffles 82 are so positioned during heating of the shorter length ingots, the circulating gases passing downwardly between the movable side baffles and side walls are prevented from short circuiting between the ends of the ingot and the side baffles, but are forced to flow toward the center portion 54*a* of the ingot. As a result, the entire length of the ingot is heated more uniformly at substantially the same rate.

It should be understood that the actuating means could be formed of pneumatic or hydraulic cylinders, screw jacks and the like in an alternate embodiment for moving of the side baffles 82. Further, each of the movable side baffles 82 may be formed as a single continuous plate member which extends between the rear wall 26 and the front wall 24 of the enclosure 16. Alternately, each of the movable side baffles could be made of a plurality of shorter plate members with one or more plate members in the length of the furnace. In such alternate embodiment, it would be expedient to provide a corresponding number of actuating means so to move each shorter plate memmber independently of the others.

In order to further direct more of the circulating gases to flow towards the center portion 54*a* of the ingot, a pair L-shaped vanes 90 may be arranged to surround the lower ends of the ingot. Each of the vanes 90 includes a vertical portion 92 and a horizontal portion 94. The vertical portion 92 extends vertically and substantially intermediate the movable side baffles 82 and the side walls. The horizontal portion 94 is joined integrally to one end of the vertical portion and extend to the shoe assemblies 56 and 58 disposed under center portion of the ingot.

From the foregoing detailed description, it can thus be seen that the present invention provides an improved ingot pusher furnace of the vertical air flow type which includes distributing means for preventing the short circuiting of heated gases around the ends of an ingot to be heated so as to produce a more uniform heat transfer along the entire length of the ingot. The distributing means may take on the form of either a pair air distribution baffles disposed adjacent the ends of the shorter length ingots or a pair of movable side baffles movable to an angled position so as to be adjacent the ends of the shorter length ingots.

While there has been illustrated and disclosed what at present is considered to be preferred embodiments of the present invention, it will be understood by those skilled in the art that various changes and modifications may be made, and equivalents may be substituted for elements thereof with departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out this invention, but that the invention will include all embodiments falling within the scope of the appended claims.

What is claimed is:

1. An ingot pusher furnace of the vertical air flow type comprising:

an insulated furnace enclosure formed by a bottom wall, a pair of side walls, a front wall, a rear wall and a top wall, said enclosure receiving a plurality of ingots to be heated;

means for heating said enclosure by heating a gaseous medium therein;

means for moving said gaseous medium within said enclosure;

a pair of vertical side baffles disposed in a parallel, spaced apart relationship to said side walls of said enclosure, each of said vertical baffles extending from the rear wall of said enclosure to the front wall, said vertical baffle having an upper end and a lower end;

a horizontal baffle having connecting members and extending from said rear wall to said front wall, said connecting members being joined fixedly to the respective upper ends of said vertical baffles; and a pair of air distribution baffles connected to the lower ends of said side baffles and extending from the lower ends thereof to the ends portions of an ingot whose length is at a minimum acceptable by the furnace, said air distribution baffles extending from said rear wall to front wall and having a plurality of slots formed therein, each of said slots having a width equal to the spacing between adjacent ingots, whereby said air distribution baffles forcing said gaseous medium contained in said enclosure to flow towards the center portions of the ingots so as to provide uniform heating throughout the ingots.

2. An ingot pusher furnace as claimed in claim 1, wherein each of said slots has a U-shaped configuration.

3. An ingot pusher furnace as claimed in claim 2, wherein each of said U-shaped slots has a length so as to correspond to an ingot whose length is at a maximum acceptable by the furnace.

4. An ingot pusher furnace as claimed in claim 1, wherein said means for moving said gaseous medium within said enclosure comprises at least one fan mounted upon said top wall of said enclosure.

* * * * *